US009243456B2

(12) United States Patent
Püttmann et al.

(10) Patent No.: US 9,243,456 B2
(45) Date of Patent: Jan. 26, 2016

(54) EARTH DRILLING DEVICE

(75) Inventors: Franz-Josef Püttmann, Lennestadt (DE); Gerhard Völkel, Erndtebrück (DE); Peter Grass, Lennestadt (DE); Meinolf Rameil, Lennestadt (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 0 days.

(21) Appl. No.: 13/254,562

(22) PCT Filed: Mar. 3, 2010

(86) PCT No.: PCT/EP2010/001316
§ 371 (c)(1),
(2), (4) Date: Nov. 10, 2011

(87) PCT Pub. No.: WO2010/099949
PCT Pub. Date: Sep. 10, 2010

(65) Prior Publication Data

US 2012/0087738 A1 Apr. 12, 2012

(30) Foreign Application Priority Data

Mar. 3, 2009 (DE) ..... 10 2009 023 910

(51) Int. Cl.
*F16L 1/028* (2006.01)
*E21B 7/20* (2006.01)

(52) U.S. Cl.
CPC ..... *E21B 7/205* (2013.01)

(58) Field of Classification Search
CPC ..... E21B 4/145; E21B 7/26; E21B 7/30; E21B 7/068; E21B 17/003
USPC ..... 405/184, 174, 175, 177; 175/219, 19, 175/51, 71, 162, 170, 296
See application file for complete search history.

(56) References Cited

U.S. PATENT DOCUMENTS

| | | | | | |
|---|---|---|---|---|---|
| 4,043,150 | A | * | 8/1977 | Baumstimler | 464/18 |
| 4,144,941 | A | * | 3/1979 | Ritter | 175/19 |
| 4,221,157 | A | * | 9/1980 | Schmidt | 91/416 |
| 4,609,052 | A | * | 9/1986 | Lewin | 173/91 |
| 4,618,007 | A | * | 10/1986 | Kayes | 175/19 |
| 4,632,191 | A | * | 12/1986 | McDonald et al. | 175/19 |
| 4,889,193 | A | * | 12/1989 | Shy | 175/62 |
| 4,905,773 | A | * | 3/1990 | Kinnan | 175/19 |
| 4,921,723 | A | * | 5/1990 | Nichols et al. | 427/488 |
| 5,025,868 | A | * | 6/1991 | Wentworth et al. | 173/91 |
| 5,096,000 | A | * | 3/1992 | Hesse | 175/22 |
| 5,112,158 | A | * | 5/1992 | McConnell | 405/184.3 |

(Continued)

FOREIGN PATENT DOCUMENTS

| | | |
|---|---|---|
| DE | 196 08 056 | 10/1997 |
| EP | 0 737 783 | 10/1996 |

(Continued)

*Primary Examiner* — Doug Hutton, Jr.
*Assistant Examiner* — Patrick Lambe
(74) *Attorney, Agent, or Firm* — Howard IP Law Group PC

(57) ABSTRACT

The invention relates to an earth drilling device (1) for boring a borehole into the soil and/or for drawing a line (9) into an underground passage, comprising at least one system line (4, 6) extending from the earth drilling device to a start region, wherein the system line is designed in an electrically insulating manner.

12 Claims, 2 Drawing Sheets

(56) References Cited

U.S. PATENT DOCUMENTS

| | | | | |
|---|---|---|---|---|
| 5,161,626 | A * | 11/1992 | Laffkas | 175/22 |
| 5,597,046 | A * | 1/1997 | Fisk | 175/67 |
| 5,895,176 | A * | 4/1999 | Puttman | 405/184 |
| 6,478,097 | B2 * | 11/2002 | Bloom et al. | 175/51 |
| 6,516,902 | B1 * | 2/2003 | Klemm | 175/296 |
| 6,585,453 | B2 * | 7/2003 | Robinson | 405/184.3 |
| 7,836,976 | B2 * | 11/2010 | Preston et al. | 175/296 |
| 2007/0104541 | A1 * | 5/2007 | Groebner et al. | 405/184 |
| 2007/0131427 | A1 * | 6/2007 | Li et al. | 166/302 |
| 2008/0308318 | A1 * | 12/2008 | Moore | 175/51 |
| 2009/0260889 | A1 * | 10/2009 | Beccu | 175/296 |
| 2010/0059277 | A1 * | 3/2010 | Burke et al. | 175/21 |

FOREIGN PATENT DOCUMENTS

| | | |
|---|---|---|
| GB | 2 025 301 | 1/1980 |
| WO | WO 03/004826 | 1/2003 |
| WO | WO 2006/083764 | 8/2006 |

* cited by examiner

EARTH DRILLING DEVICE

CROSS-REFERENCES TO RELATED APPLICATIONS

This application is the U.S. National Stage of International Application No. PCT/EP2010/001316, filed Mar. 3, 2010, which designated the United States and has been published as International Publication No. WO 2010/099949 and which claims the priority of German Patent Application, Serial No. 10 2009 023 910.3, filed Mar. 3, 2009, pursuant to 35 U.S.C. 119(a)-(d).

BACKGROUND OF THE INVENTION

The invention relates to an earth drilling device for drilling a borehole into the soil and/or for pulling a pipe into an underground channel.

Such earth drilling devices are used for a trenchless installation of utility lines, such as fresh water or wastewater lines, gas lines, telecommunication lines or electrical power cables, drainage pipes as well as geothermal probes into the soil or for a trenchless replacement of an already existing line.

Various different earth drilling devices are known in the art, wherein the earth drilling device to be used are typically selected depending on the type of the line to be installed, the length of the line to be installed or to be replaced, the accessibility of the start and target region of the line segment to be installed or replaced, and particularly also depending on the condition of the soil in which the line is to be installed or replaced.

A widely used type of earth drilling devices includes a drive unit which can be arranged in the start region (in an excavation pit, a shaft as well as at a location on the surface) of a borehole to be drilled and which drives a drill rod with a drill head disposed at the front end for driving the drill head through the soil along the desired drilling path. With such earth drilling devices, a pilot hole extending from the start region to a target region (likewise an excavation pit, a shaft or a location on the surface) is typically introduced into the soil in a first drilling operation. The drill head is then replaced in the target region by an expansion head to which the pipe to be pulled into the borehole can be attached. When the drilling rod with the attached expansion head and the new pipe are retracted with the drive unit, the previously produced pilot bore is expanded and the new pipe is simultaneously pulled in.

Another type of widely used earth drilling devices relates to the so-called earth rockets. These are self-propelled drilling rams which include an internal impact drive used to intermittently advance the earth rocket through the soil. The impact drive is continuously supplied with the required energy via compressed air which is supplied to the earth rocket through a trailing supply hose.

Until now, earth rockets have primarily been used to introduce pilot bores into the soil. In a subsequent operation, an expansion head to which the new pipe to be pulled is attached is then pulled through the pilot bore with a pulling device, whereby the pilot bore is expanded and the new pipe is pulled in. The new pipe has typically not been pulled directly with the earth rockets because of the problematic attachment of the new pipe to the earth rocket due to the intermittent impact operation of the earth rocket, which regularly caused damage to the new pipe. Because improvements in the attachment of a new pipe to an earth rocket have since been made, a direct pipe replacement, wherein the new pipe is directly attached to the earth rocket, is now more frequently used.

Impact drilling processes where the new pipe is advanced in the soil by applying pressure forces are used regularly only with pipes having a very large diameter. In the aforedescribed direct pipe replacement with an earth rocket—as well is in almost all other processes for trenchless installation of a pipe—the new pipe is pulled through the underground channel, i.e., by applying pulling forces which are applied to the new pipe either at the front via an adapter or via a pulling element and from the back end via a rear adapter. In the second case, although the new pipe is pulled in by a pulling process, the new pipe is actually rather pushed. When the pulling forces are applied to the front end of the new pipe, the new pipe is frequently additionally tensioned against the earth drilling device by a pulling element (e.g., pulling cable, chain, pulling rods) extending through the new pipe and a corresponding rear adapter, so as to prevent the pipe segments in a pipe string consisting of individual pipe segments from becoming detached from each other. In a long pipe which is typically made of plastic, tensioning may prevent overstretching of the plastic. A corresponding system for tensioning a new pipe in an earth drilling device is disclosed, for example, in DE 196 08 056 C1. Like essentially all components of an earth drilling device, the pulling element as well as the tensioning adapter are also made of a metal and in particular steel, because steel is inexpensive and withstands high mechanical stress. Metals, such as steel, also have a very high electrical conductivity.

In particular in a direct pipe replacement with an earth rocket, where the drilling the borehole and pulling in the new pipe occurs simultaneously, problems may be encountered when the earth rocket hits a current-conducting underground cable, partially destroying the underground cable. This has the risk that the current is conducted via the earth rocket and the frequently metal-reinforced and hence also electrically conducting supply hose and via the tensioning element provided for tensioning the new pipe to the start region, which can potentially endanger an operator coming into contact with these current-carrying cables.

Based on this conventional technology, it was the object of the invention to reduce the risk of endangering an operator when an earth drilling device hits a current-carrying underground cable.

SUMMARY OF THE INVENTION

According to the core concept of the invention, a system line extending from an earth drilling device operating in the soil to a start region which is accessible, in particular, by an operator, is constructed to be electrically insulating to prevent a voltage from being applied to the system line when the earth drilling device hits a current-carrying cable. This can eliminate the danger to the operator as a result of an electric shock.

An earth drilling device according to the invention for introducing a borehole into the soil and/or for pulling a pipe into an underground channel thus includes at least one system line extending from the earth drilling device to a start region, and is characterized in that at least a rear section (i.e., the section extending into the start shaft) of the at least one system line is electrically insulated from at least one front section of the earth drilling device (in particular the drill head).

Within the context of the present invention, "earth drilling device" refers to all devices which can be used for introducing a borehole into the soil and/or for pulling a pipe into an already existing underground channel. These devices may include, for example, self-propelled earth drilling devices, such as earth rockets. Also included are, for example, so-called expansion heads, which are regularly pulled through an existing borehole or an already existing old pipe with a pulling element and to which the new pipe to be pulled in is attached.

Within the context of the present invention, "line" is meant to refer to all lines which can be introduced into the soil in conjunction with the trenchless line installation or line replacement; these include, in addition to telecommunication lines and electric cables, in particular also pipes used for supplying water and gas.

Within the context of the present invention, "soil" is meant to refer, in addition to the natural soil, also to the accumulation of material on the ground surface, into which earth boreholes are introduced particularly with the goal to introduce a line. Included are here in particular man-made mounts of soil, scree and refuse.

The term "underground channel" is meant, in particular, to include boreholes and already installed pipes.

Within the context of the present invention, "system line" refers to any element which is directly or indirectly connected with the earth drilling device and which extends from the earth drilling device to the end of the underground channel, i.e., into the start region (in particular an excavation pit, a shaft or a location on the surface, from where the earth drilling device can be started and/or operated). This includes, in particular, supply hoses and, in particular, compressed air hoses for earth rockets, as well as tension cables, tension chains, tension rods or similar tensioning elements for tensioning a line attached to the earth drilling device.

According to the invention, an adapter element may also be part of the system line, wherein the adapter element may be used to connect, for example, a supply hose or a tensioning element with the earth drilling device, if the adapter element is constructed to be electrically insulating. The subject matter of the invention may also include an embodiment where the electrical insulation according to the invention is implemented in (a section of) the earth drilling device itself.

In a preferred embodiment of the earth drilling device according to the invention, the insulating electrical properties of the at least one system line may be attained by forming the entire system line itself or a section thereof as an insulator.

In another preferred embodiment, an insulating adapter may be integrated in the otherwise electrically conducting system line. The insulating adapter is an insulating element which is integrated in the system line and short compared to the length of the system line, thereby preventing transmission of current to the start region. This embodiment has a substantial advantage in that the entire system line need not be electrically insulating, but may still be made of a metal and in particular steel, as is common with earth drilling devices, wherein only the insulating adapter may be constructed to be electrically insulating. This helps to keep any additional costs associated with the insulating electrical configuration of the system line low. The insulating adapter may be integrated in the system line, for example, via quick connect elements (e.g., threads, bayonet locks, etc.) disposed on the corresponding ends of the system line and of the insulating adapter.

In a preferred embodiment of the present invention, the insulating material may include a ('technical) ceramic material or a ceramic composite material. Such materials may have high mechanical strength and are suitable for insulating even high currents.

In a particularly preferred embodiment of the earth drilling device according to the invention, the system line and/or the insulating adapter may be constructed to have a hydrophobic surface. Hydrophobic surfaces are characterized in that they have very a small adhesion to water, causing water to form "beads", i.e., the water molecules contract into larger droplets. The formation of "beads" of the water reduces the risk of formation of electrically conducting droplet traces on the electrically insulating system line or the provided insulating adapter due to the humidity in the soil; this could otherwise lead to impurity-layer arcing and consequently conduction of electric current along the surface of the otherwise insulating electrical system line. For example, polytetrafluoroethylene (PTFE) or polyoxymethylene (POM) can be used to coat a supply line or an insulating adapter according to the invention with an insulating hydrophobic coating.

The idea of the invention to construct at least a system line of an earth drilling device to be electrically insulating may advantageously also be applied to a supply hose for the supplying a pressure fluid for operating the earth drilling device.

According to another preferred embodiment according to the invention, a system line may be constructed as a tensioning element for tensioning a pipe to be pulled with the earth drilling device.

BRIEF DESCRIPTION OF THE DRAWING

The invention will now be described with reference to an exemplary embodiment illustrated in the drawings.

The drawings show in.

DETAILED DESCRIPTION OF PREFERRED EMBODIMENTS

Figure 1:
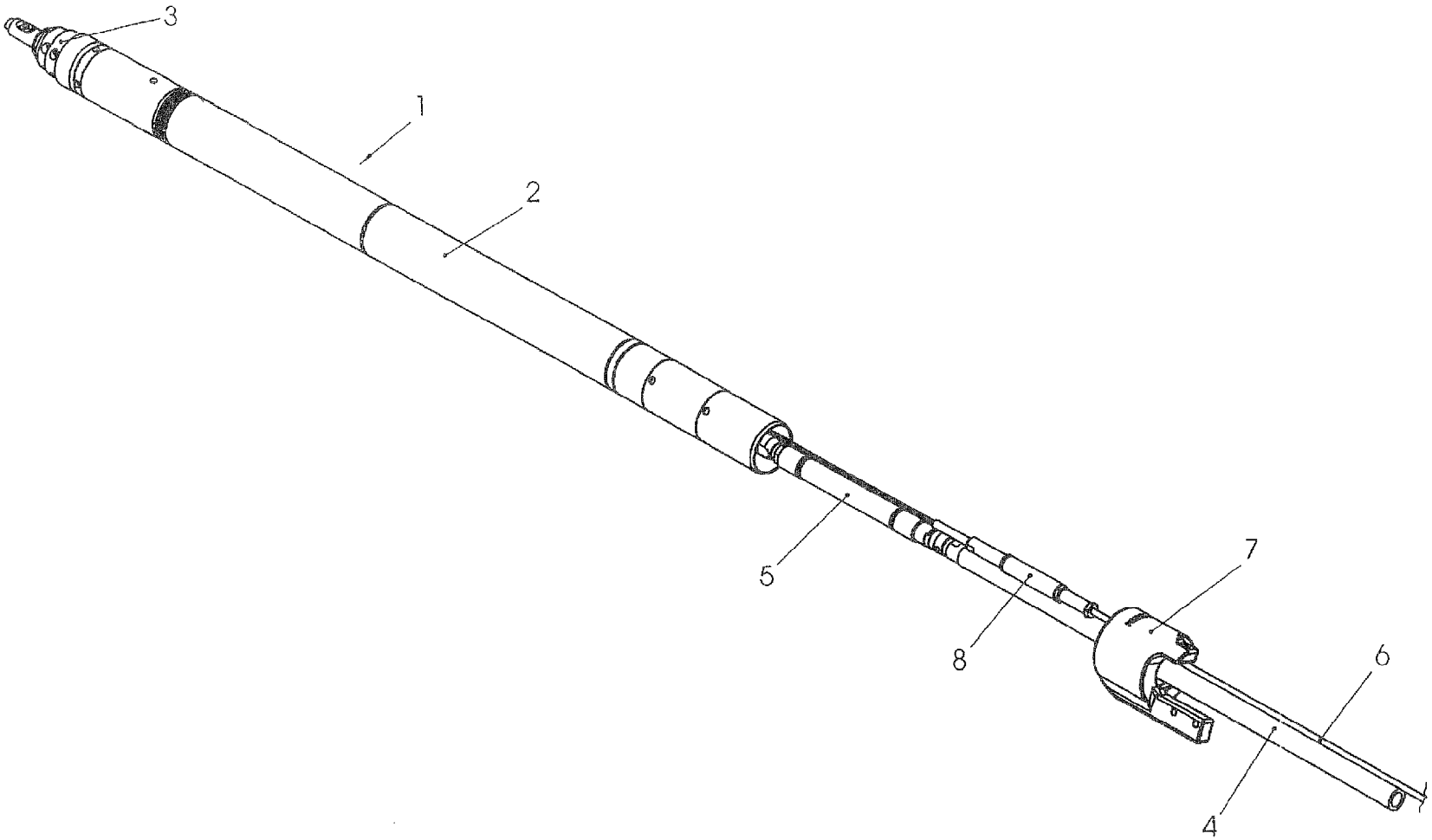
FIG. 1: an earth drilling device according to the invention in an isometric view.

FIG. 1 shows an earth drilling device according to the invention in an isometric view. The earth drilling device includes a self-propelled impulse drilling device, i.e., a so-called "earth rocket" 1. The structure and function of such earth rockets 1 are sufficiently known in the art and will therefore not be described in more detail. As known in the art, the earth rocket 1 is essentially entirely made of steel and includes an impact piston (not illustrated) which is movable inside a housing 2 of the earth rocket 1 in a longitudinal axial direction; the impact piston can be cyclically moved back and forth with compressed air, wherein the impact piston hits during each cycle an impact surface disposed in the front region of a drill head 3 of the earth rocket 1, thereby transferring the kinetic energy of the impact piston to the earth rocket 1; the earth rocket 1 is hereby intermittently advanced through the soil. A compressed air hose 4, which is connected to the earth rocket 1 via a (hose) adapter 5 and extends through the previously created borehole to the interior of a excavated start pit (not illustrated), is provided for supplying compressed air to the earth rocket 1. The earth rocket 1 is started in the excavated start pit, while the compressed air generator (not illustrated) is also located in the excavated start pit.

Moreover, a tension cable 6 made of steel is connected to the earth rocket 1, wherein the tension cable 6 can be used to tension a new pipe 9, which is to be pulled into the newly created borehole together with the earth rocket 1, with the earth rocket 1. The front end of the new pipe is then slid onto the compressed air hose and the tension cable and plugged into the rear end of the earth rocket 1 which is constructed as a sleeve. An adapter element 7 is then placed on the compressed air hose 4 and the tension cable, causing it to come into contact with the rear end of the new pipe 9. The adapter element 7 is then connected with the tension cable 6, thus preventing elongation of the new pipe 9 due to the friction forces generated during the pulling operation and contact with the soil, which could cause a strand of new pipe composed of individual sections to be pulled apart or an elongated pipe made of plastic to be impermissibly stretched.

According to the invention, the hose adapter 5 used to connect the compressed air hose with the earth rocket is constructed so as to be electrically insulating. The hose adapter 5 may include an insulating body (e.g., an electrically non-conducting compressed air hose segment) with quick connect elements, which engage with corresponding quick connect elements of the compressed air hose 4 (frictionally and/or interlocking). Likewise, an electrically insulating (tension cable) adapter 8 is integrated into the tension cable, which may also include an insulating body (e.g., made of POM) with (at least) two quick connect elements, which engage with corresponding quick connect elements of the tension cable (frictionally and/or interlocking). The two electrically insulating adapters 5, 8 prevent current flow from the tip of the earth drilling device via the compressed air hose and/or the tension cable to the region of the excavated start pit in the event that the drill head 3 of the earth rocket 1 hits a previously installed current-conducting underground cable (not illustrated). According to the invention, endangerment of a person located in the excavated start pit from a current-conducting compressed air hose or a current-conducting tension cable can thereby be prevented.

Figure 2:
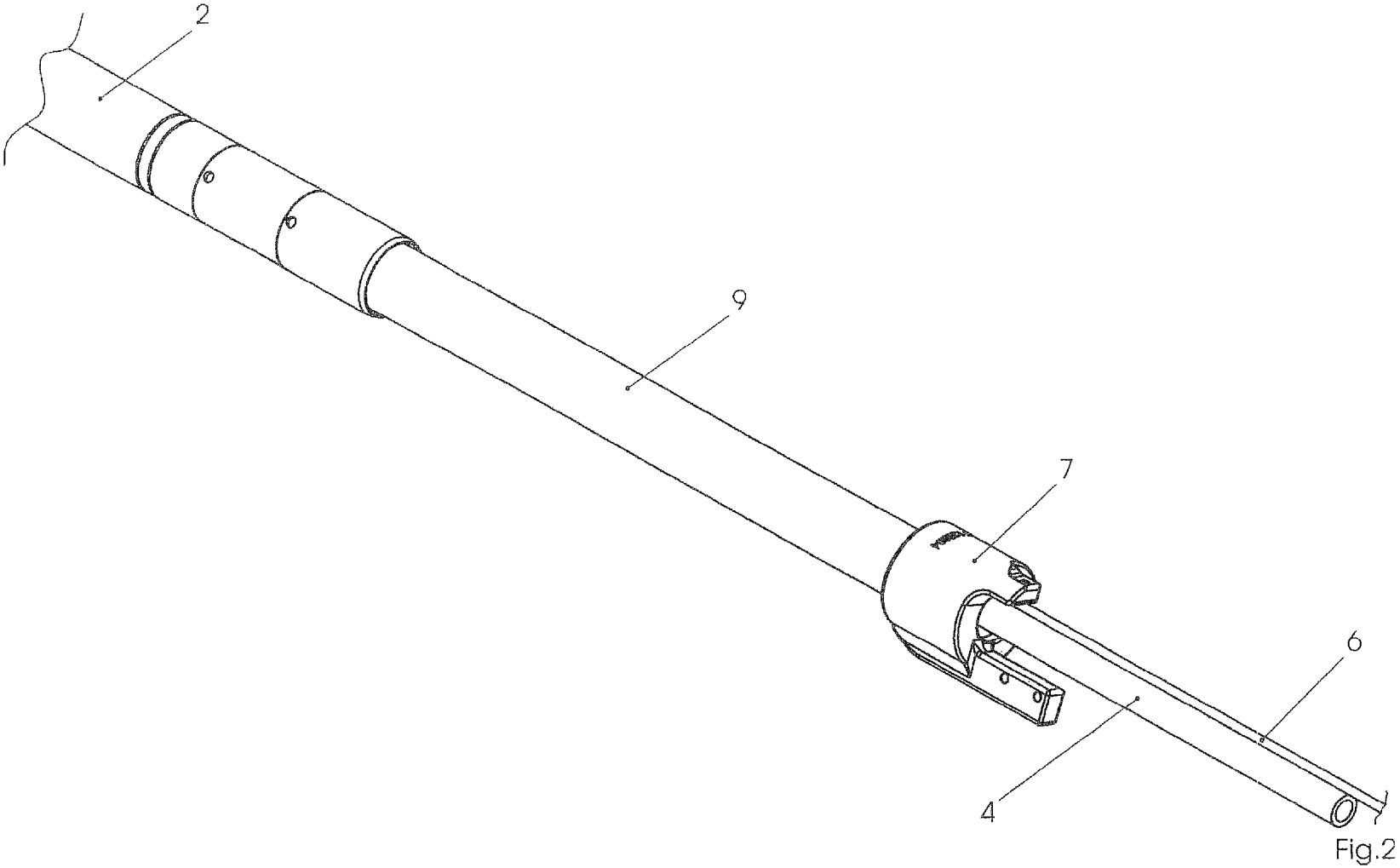
FIG. 2: a detail of the earth drilling device of FIG. 1 with an installed protective pipe.

The adapters 5, 8 are surrounded during the operation by the new pipe 9 and are thus protected against external influences (see FIG. 2).

The invention claimed is:

1. An earth drilling device for drilling an underground channel and pulling a new pipe into the underground channel, comprising a tension cable made of steel and connecting the new pipe to a rear section of the earth drilling device, an adapter element, adapted for maintaining length of the new pipe, connected to the tension cable, wherein the new pipe is configured to be secured between the adapter element and the rear section of the earth drilling device, and an electrical insulator arranged between the earth drilling device and an end of the tension cable proximate to the earth drilling device to prevent flow of electric current from at least a front section of the earth drilling device to the tension cable, wherein the front section of the earth drilling device leads the rear section of the earth drilling device during both of the operations of drilling the underground channel and pulling the new pipe into the underground channel.

2. The earth drilling device of claim 1, further comprising at least one system line attached to the rear section of the earth drilling device and extending from the earth drilling device to a start region, for supplying the earth drilling device with a working fluid from the start region.

3. The earth drilling device of claim 2, wherein the at least one system line is constructed to be electrically insulating in its entirety.

4. The earth drilling device of claim 2, further comprising an insulating adapter integrated in the at least one system line.

5. The earth drilling device of claim 2, wherein the earth drilling device comprises electrical insulation for electrically insulating the at least one system line with respect to the front section of the earth drilling device.

6. The earth drilling device of claim 2, wherein the at least one system line comprises a hydrophobic surface.

7. The earth drilling device of claim 6, wherein the at least one system line comprises at least one surface layer made of POM or PTFE.

8. The earth drilling device of claim 2, wherein the at least one system line is constructed as a supply hose for supplying a pressure fluid for operating the earth drilling device.

9. The earth drilling device of claim 1, wherein the electrical insulator comprises a technical ceramic material or a ceramic composite material.

10. The earth drilling device of claim 1, wherein the electrical insulator comprises a hydrophobic surface.

11. The earth drilling device of claim 10, wherein the electrical insulator comprises at least one surface layer made of POM or PTFE.

12. The earth drilling device of claim 1, wherein the electrical insulator is arranged along an axis of the tension cable and defines a tension-carrying, electrically-insulating, interruption between an end of the tension cable and the earth drilling device.

* * * * *